US006648556B1

(12) United States Patent
White

(10) Patent No.: US 6,648,556 B1
(45) Date of Patent: Nov. 18, 2003

(54) AUTOMATICALLY ADJUSTABLE CAISSON CLAMP

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 10/352,760

(22) Filed: Jan. 27, 2003

Related U.S. Application Data

(63) Continuation of application No. 09/921,106, filed on Aug. 1, 2001, now abandoned.
(60) Provisional application No. 60/222,347, filed on Aug. 1, 2000.

(51) Int. Cl.[7] ..... B25B 1/02; E21B 1/02
(52) U.S. Cl. ..... 405/249; 269/153; 175/171
(58) Field of Search ..... 405/198, 223, 405/232, 245, 249, 303; 173/49; 175/90, 203, 171, 189; 269/140–145, 152, 153

(56) References Cited

U.S. PATENT DOCUMENTS 628,962 A * 7/1899 Speer ..... 173/124
3,172,485 A * 3/1965 Spannhake et al. ..... 173/147
3,391,435 A * 7/1968 Lebelle ..... 24/463
3,734,209 A * 5/1973 Haisch et al. ..... 175/57
3,871,617 A * 3/1975 Majima ..... 254/29 R
5,076,090 A * 12/1991 Cetnarowski ..... 72/407
5,117,925 A * 6/1992 White ..... 173/162.1
5,213,449 A * 5/1993 Morris ..... 405/232
5,263,544 A * 11/1993 White ..... 173/162.1
5,355,964 A * 10/1994 White ..... 173/1
5,544,979 A * 8/1996 White ..... 405/232
5,609,380 A * 3/1997 White ..... 294/104
5,653,556 A * 8/1997 White ..... 405/249
5,794,716 A * 8/1998 White ..... 173/189
6,039,508 A * 3/2000 White ..... 405/232
6,216,394 B1 * 4/2001 Fenelon ..... 49/349

* cited by examiner

*Primary Examiner*—Thomas B. Will
*Assistant Examiner*—Tara L. Mayo
(74) *Attorney, Agent, or Firm*—Michael R. Schacht; Schacht Law Office, Inc.

(57) ABSTRACT

A clamp system for allowing a pile driving/pulling system to be attached to a caisson to be driven into or extracted from the earth. The clamp system comprises a structural member, first and second clamp systems, first and second locking systems, and a clamp displacement system. The clamp displacement assembly is operatively connected between the structural member and the first and second clamp assembly. When the first and second clamp systems are disengaged from the pile and the first and second locking systems are disengaged from the structural member, the clamp displacement system may be operated to obtain a desired clamp distance between the first and second clamp assemblies.

17 Claims, 4 Drawing Sheets

3
82
46
B
52
22
40
72
44
90
A
70
70
56
50
42
9
9
72
3
84

B
46
22
40
50
94
82
54
88
44
74
90
A
80
92
86
42
74
84
96
52

22
40
5
5
72
72
70
70
82
44
42
74

22
74
88
44
40
82
80
84
50
42
74
86
54
52

AUTOMATICALLY ADJUSTABLE CAISSON CLAMP

RELATED APPLICATIONS

This is a continuation of U.S. Ser. No. 09/921,106 filed Aug. 1, 2001, now abandoned, which claims priority of U.S. Provisional Application Ser. No. 60/222,347, which was filed on Aug. 1, 2000.

TECHNICAL FIELD

The present invention relates to clamping assemblies for pile drivers and, more specifically, to clamping assemblies that allow vibratory pile drivers to be connected to caissons for driving caissons into the earth.

BACKGROUND OF THE INVENTION

Modern construction design often requires caissons to be driven into the earth at desired locations. In the context of the present invention, the term "caisson" will be used to refer to hollow, cylindrical members that are driven into the earth. Caissons are normally used as part of the footing for a structural element such as a building foundation or bridge pier, but the end use of the caisson is not a part of the present invention.

Pile driving systems that impart vibratory loads are highly effective at driving elongate members such as piles, caissons, and the like into the earth. The vibratory forces of such vibratory pile deriving systems must be transmitted to the member to be driven by a clamping assembly. The clamping assembly ensures that the vibratory forces in both directions are applied to the member to be driven.

In the case of caissons, the clamping assembly conventionally comprises a rigid structural member or assembly on which are mounted two or more hydraulic clamps. The hydraulic clamps are spaced from each other along the structural member to grip the upper edge of the caisson such that the vibratory loads are symmetrically applied along the centerline of the caisson.

A basic clamping assembly for relatively small-diameter caissons comprises a single structural member and two hydraulic clamps. The hydraulic clamps are movable along the structural member to allow the clamping assembly to accommodate caissons of different diameters within a range defined by the length of the structural member.

Conventionally, the hydraulic clamps are moved by hand to desired locations on the structural member and fixed. The entire assembly is then lifted to the top of the caisson and displaced such that the top edge of the caisson enters the hydraulic clamps. The clamps are then actuated to grip the caisson and the process of driving the caisson can be commenced.

The need thus exists for improved caisson clamping systems that simplify the process of attaching a vibratory device to a caisson to be driven into the earth.

RELATED ART

The following prior art references illustrate the background of the present invention.

U.S. Pat. No. 5,653,556 to White discloses a clamp system for connecting caissons to a vibratory driver/extractor. The clamp system employs a beam assembly that supports four clamps at locations angularly spaced about the circumference of the caisson.

U.S. Pat. No. 5,544,979 to White discloses a clamp system for connecting caissons or piles to a vibratory pile driver/extractor in which the clamp engages a side surface rather than an upper end of the caisson or pile.

U.S. Pat. Nos. 5,117,925 and 5,263,544 to White disclose shock absorbing systems for use with a vibratory pile driver/extractor. These shock absorbing systems could be used with the clamp systems and methods of the present invention.

U.S. Pat. No. 5,609,380 to White discloses a clamp assembly for connecting a vibratory pile/extractor to a pile. Clamping forces are applied to the sides of the pile.

SUMMARY OF THE INVENTION

The present invention is a clamp system for allowing a pile driving/pulling system to be attached to a caisson to be driven into or extracted from the earth. The clamp system comprises a structural member, first and second clamp systems, first and second locking systems, and a clamp displacement system. The clamp displacement assembly is operatively connected between the structural member and the first and second clamp assembly. When the first and second clamp systems are disengaged from the pile and the first and second locking systems are disengaged from the structural member, the clamp displacement system may be operated to obtain a desired clamp distance between the first and second clamp assemblies.

Other features and aspects of the present invention will become apparent from the following detailed description of the invention.

DETAILED DESCRIPTION OF THE INVENTION

Figure 1:
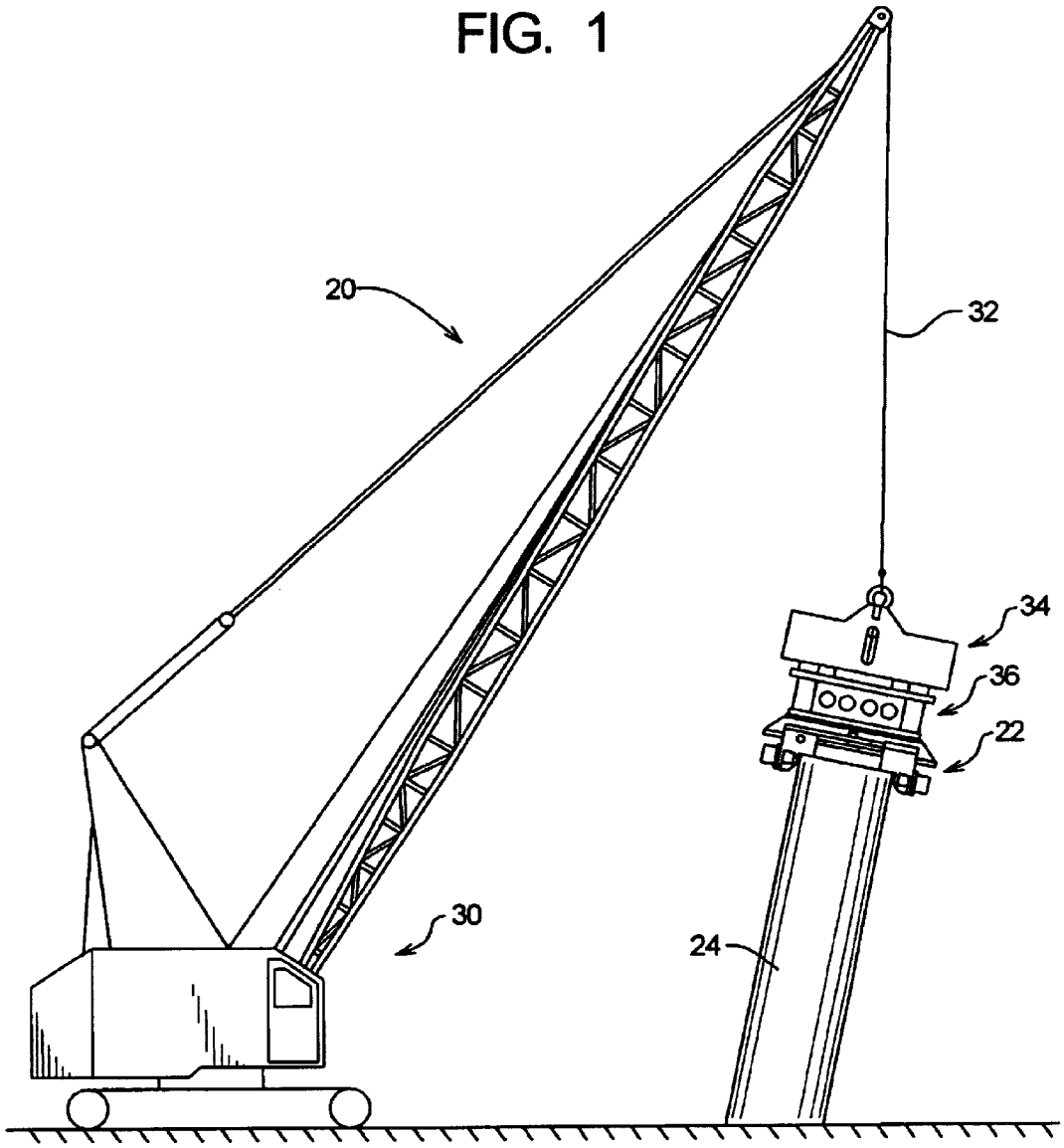
FIG. 1 is a side elevation view depicting a caisson driving system employing a clamp assembly constructed in accordance with the present invention being used to drive a caisson.
Figure 2:
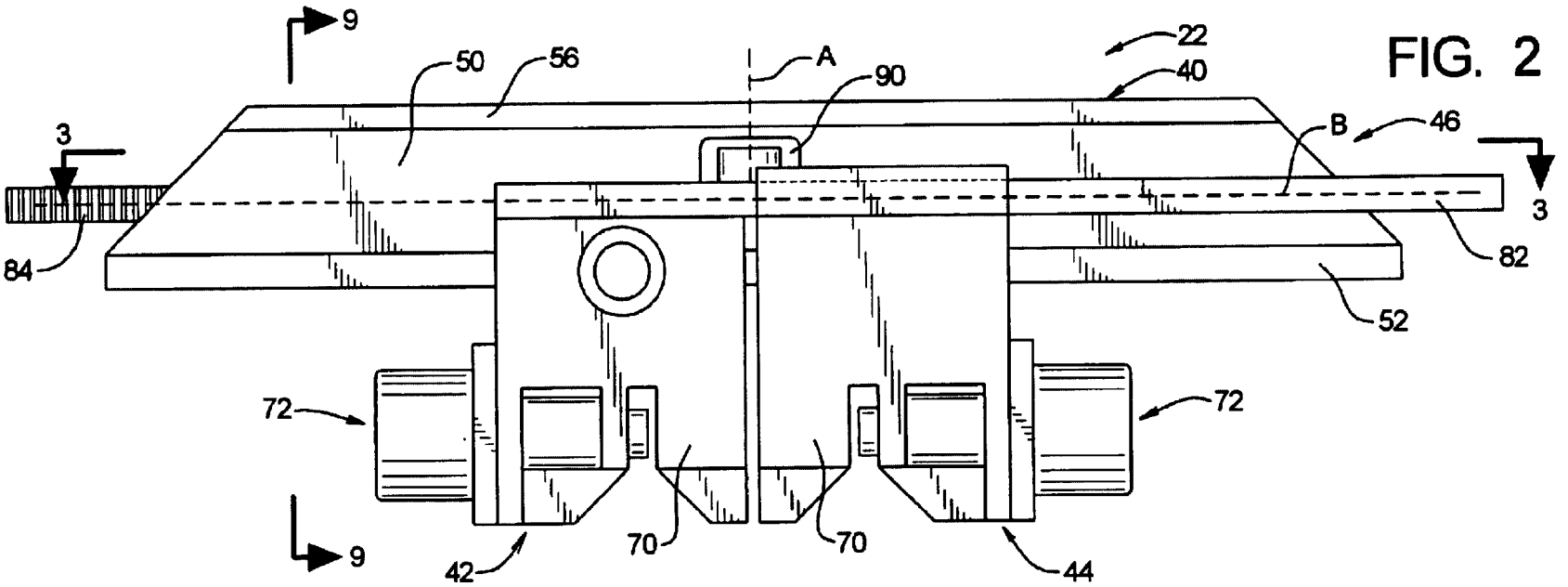
FIG. 2 is a front elevation view of the clamping assembly depicted in FIG. 1 in a first configuration.
Figure 3:
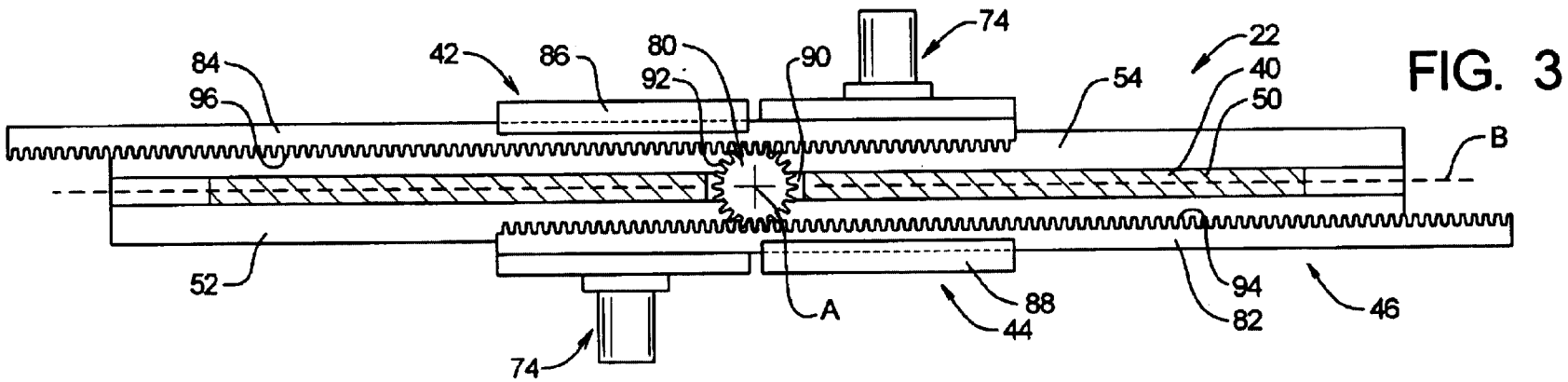
FIG. 3 is a top plan view of the clamping assembly of FIG. 1 taken along lines 3—3 in FIG. 2.
Figure 4:
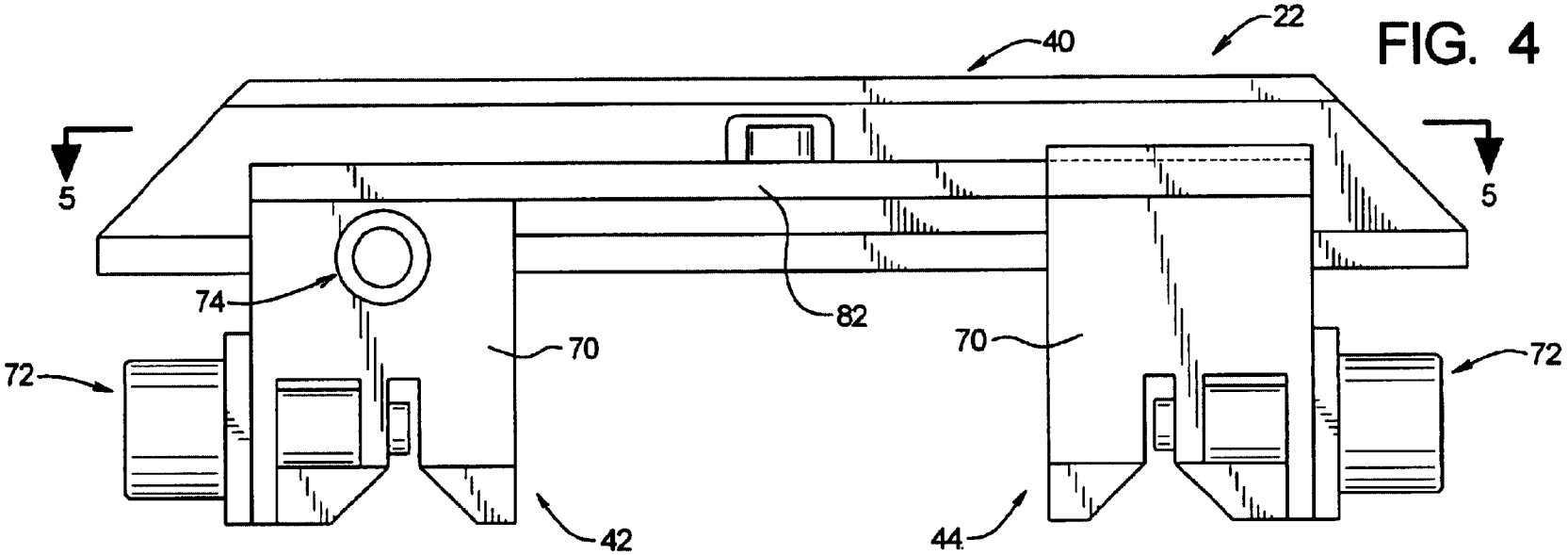
FIG. 4 is a front elevation view of the clamping assembly depicted in FIG. 1 in a second configuration.
Figure 5:
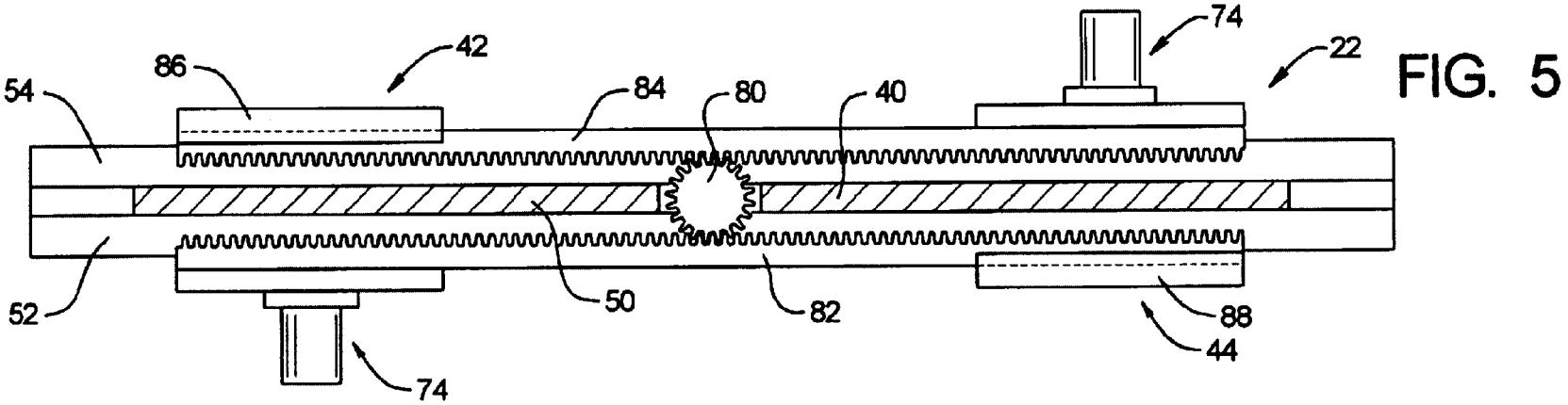
FIG. 5 is a top plan view of the clamping assembly of FIG. 1 taken along lines 5—5 in FIG. 4.

Referring initially to FIG. 1 of the drawing, depicted therein is a caisson driving system 20 employing a clamp assembly 22 constructed in accordance with, and embodying, the principles of the present invention. The exemplary caisson driving system 20 is shown driving a caisson 24.

The caisson driving system 20 further comprises a crane 30 having a crane cable 32, a suppression assembly 34 suspended from the crane 30 by the crane cable 32, and a vibratory device 36 rigidly connected to the suppression assembly 34. The vibratory device 36 is rigidly connected to the clamp assembly 22, and the clamp assembly is detachably clamped onto the caisson 24. The caisson 24, crane 30, crane cable 32, suppression assembly 34, and vibratory device 36 all are or may be conventional and will not be described in detail herein.

Referring now to FIGS. 2–5, these figures show that the clamp assembly 22 comprises a structural member or beam 40, first and second clamps 42 and 44, and a clamp displacement system 46.

Figure 9:
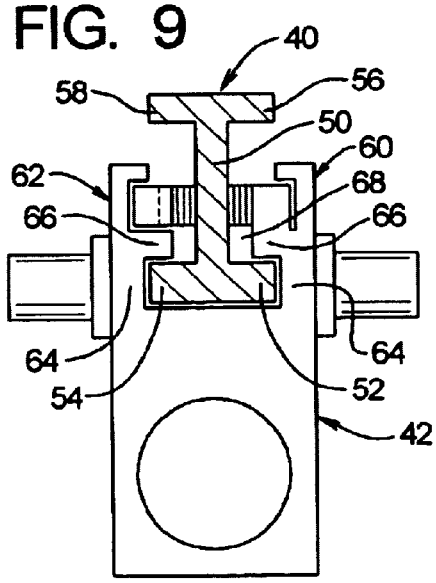
FIG. 9 is an end elevation section view taken along lines 9—9 in FIG. 2.

The structural member 40 has a central portion 50 and first and second rail projections 52 and 54 laterally extending from the center portion 50. As shown in FIG. 9, the structural member 40 further comprises first and second upper projections 56 and 58 extending from the central portion 50. In the exemplary clamping assembly 20, the first and second rail projections 52 and 54 are co-planar, the first and second upper projections 56 and 58 are co-planar and parallel to the first and second rail projections 52 and 54, and all of these projections are perpendicular to the central portion 50; the exemplary structural member 40 is thus an I-beam.

As perhaps best shown in FIG. 9, the clamps 42 and 44 each comprise first and second rail brackets 60 and 62 each having upward extending portions 64 and inwardly extending portions 66. The inwardly extending portions 66 define a slot 68 that receives the center portion 50 of the structural member 40; however, the slot 68 is narrower than the combined dimensions of the rail projections 52 and 54. The rail brackets 60 and 62 thus engage the rail projections 52 and 54 such that, during normal operation, the clamps 42 and 44 may move horizontally along the structural member 40 but may not move down relative to the structural member 40.

As perhaps best shown in FIGS. 2–5, the clamps 42 and 44 each further comprise a main housing 70, a hydraulic clamping system 72, and a hydraulic locking system 74. The hydraulic clamping system 72 and locking systems 74 are mounted to the main housing. These systems 72 and 74 are or may be conventional and will not be described herein beyond the extent necessary for a complete understanding of the present invention.

The clamping system 72 engages the upper edge of the caisson 24 selectively to fix the caisson 24 relative to the clamps 42 and 44 through the clamp housings 70. The locking system 74 engages the structural member 40 selectively to prevent relative movement between the clamps 42 and 44 and the structural member 40. As generally discussed above, the clamping systems 72 and locking systems 74 each comprise a physical assembly corresponding to the structure identified by reference characters 42 and 44 in the drawing. As will be discussed in further detail below, these systems 72 and 74 further comprise a hydraulic portion that operates the physical assembly in a known manner to obtain the result described herein.

The clamping system 72 and locking system 74 are thus both actuated to fix the position of the caisson 24 relative to the structural member 40; both the clamping system 72 and the clocking system 74 will be actuated during driving of the caisson 24. During adjustment of the positions of the clamps 42 and 44 (as will be described in further detail below), the clamps 42 and 44 will be disengaged from the caisson 24 (with the clamping systems 72 de-actuated), and the locking systems 74 must be de-actuated.

The exemplary clamp displacement system 46 comprises a drive pinion 80, first and second rack members 82 and 84, and first and second guide members 86 and 88. In the exemplary clamp assembly 22, the drive pinion 80 is mounted in an opening 90 in the structural member 40 such that its axis of rotation A is vertical and extends substantially through the center of gravity of the structural member 40.

The drive pinion 80 comprises drive teeth 92, and the rack members 82 and 84 comprise rack teeth 94 and 96 sized and dimensioned to engage the drive teeth 92.

The first rack member 82 is rigidly connected to the first clamp 42, and the second rack member 84 is rigidly connected to the second clamp 44. In particular, in the exemplary clamp assembly 22, when the racks 82 and 84 are attached to the clamps 42 and 44 and the clamps 42 and 44 are supported by the structural member 40 as described above, the racks 82 and 84 extend from their associated clamps in opposite directions on opposite sides of the structural member 40. In addition, the racks 82 and 84 are spaced on either side of the central portion 50 of the structural member 40 such that the rack teeth 94 and 96 engage the drive teeth 92.

The second guide member 88 is rigidly connected to the first clamp 42, and the first guide member 86 is rigidly connected to the second clamp 44. In addition, the first guide member 86 is arranged on an opposing side of the structural member central portion 50 from the first rack member 82, and the second guide member 88 is arranged on an opposing side of the central portion 50 from the second rack member 84.

When the clamps 42 and 44 are supported by the structural member 40 as described above, the first and second guide members 86 and 88 receive the second and first rack members 84 and 82, respectively.

The guide members 86 and 88 support the rack members 82 and 84 such that these members 82 and 84 stay parallel to each other during normal operation. In particular, when the vibratory device is operating, forces are generated that will tend to rotate the rack members 82 and 84 in a vertical arc centered at the point where the rack members 82 and 84 are attached to the clamps 42 and 44. The guide members 86 and 88 limit this rotational movement of the rack members 82 and 84 relative to the clamps 42 and 44 and thus reduce fatigue and wear on the rack members 82 and 84.

The exemplary clamping system 72, locking system 74, and drive pinion 76 are all operated by pressurized hydraulic fluid. The clamping system 72 and locking system 74 comprise a hydraulic piston assembly that displaces a clamp member when pressurized hydraulic fluid is applied to the piston, while the drive pinion 76 comprises a hydraulic motor that creates rotational motion from pressurized hydraulic fluid. For simplicity and clarity, the source of the pressurized hydraulic fluid is not shown in the drawings, but is or may be conventional.

The operation of the clamping system 72, locking system 74, and drive pinion 76 may be remotely controlled, for example by an operator of the crane 30, by controlling the flow of pressurized hydraulic fluid from the source. The design of the fluid control circuitry required to allow the operator to control the clamping and locking systems 72 and 74 and drive pinion 76 is conventional, would be apparent to one of ordinary skill in the art, and will not be described in detail herein.

The clamp assembly 22 is operated in the following general manner. Initially, the clamping systems 72 and locking systems 74 are de-actuated. The operator then determines the size, or diameter, of the first caisson to be driven and operates the drive pinion 80 to displace the racks 82 and 84, and thus the clamps 42 and 44, along a longitudinal axis B of the structural member 40. When the effective locations of the clamps 42 and 44 are spaced from each other a distance approximately equaling the diameter of the first caisson to be driven, the drive pinion 80 is stopped. The entire clamp assembly 22 is then displaced until the clamps 42 and 44 receive opposing edge portions of the first caisson to be driven. The drive pinion 80 will engage the racks 82 and 84 to inhibit incidental movement of the clamps 42 and 44 during maneuvering of the clamp assembly 22.

When the caisson edges are received by the clamps 42 and 44, the clamping systems 72 are actuated to fix the caisson relative to the clamp housings 70. The locking systems 74 are then actuated to fix the clamp housings 70 relative to the structural member 40. The caisson driving system 20 may then be used to drive the first caisson.

If the remaining caissons to be driven are the same diameter as the first caisson, the clamping systems 72 are de-actuated, the clamp assembly 22 is maneuvered such that the clamps 42 and 44 receive the upper opposing edge portions of the next caisson, and the clamping systems 72 are actuated to fix the position of the new caissons relative to the clamp housings 70. The caisson driving system 20 may than be used to drive the new caisson.

If the next caisson to be driven has a different diameter as the first caisson, the process described above for the first caisson is repeated. The present invention is thus of particular importance in situations where caissons of different diameters are to be driven. For example, a design may call for caissons of a first diameter to be alternated with caissons of a second diameter. The present invention greatly reduces the overall time to drive all of the caissons because the process of reconfiguring the clamp assembly 22 for the different caisson diameters is significantly quicker.

Figure 6:
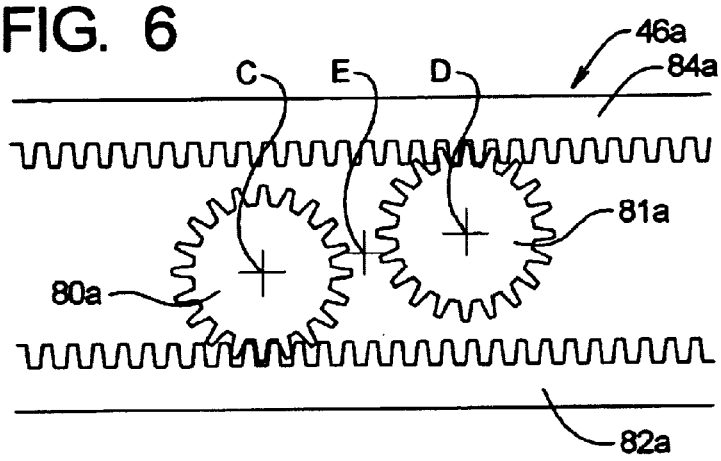
FIG. 6 is a somewhat schematic, top plan view of a first alternate clamp displacement system that may be used by the clamping assembly of FIG. 1.

Referring now to FIG. 6, schematically depicted therein is an alternate clamp displacement system 46*a* that may be substituted for the clamp displacement system 46 described above. This displacement system 46*a* is similar to the system 46 and will be described only to the extent that it differs from the system 46.

The system 46*a* comprises first and second drive pinions 80*a* and 81*a* associated with the racks 82*a* and 84*a*, respectively. The axes of rotation C and D of the exemplary drive pinions 80*a* and 81*a* are symmetrically arranged relative to a vertical axis E extending through the center of gravity of the clamp assembly 22. The use of two drive pinions 80*a* and 81*a* allows the racks 82*a* and 84*a*, and thus the clamps 42 and 44 attached thereto, to be independently moved along the structural member 40.

Figure 7:
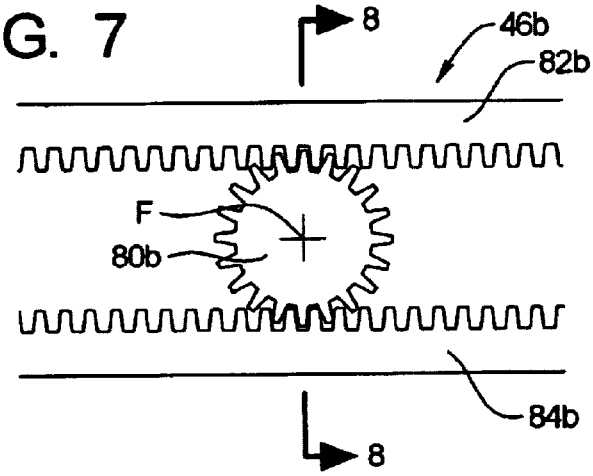
FIG. 7 is a somewhat schematic, top plan view of a second alternate clamp displacement system that may be used by the clamping assembly of FIG. 1.
Figure 8:
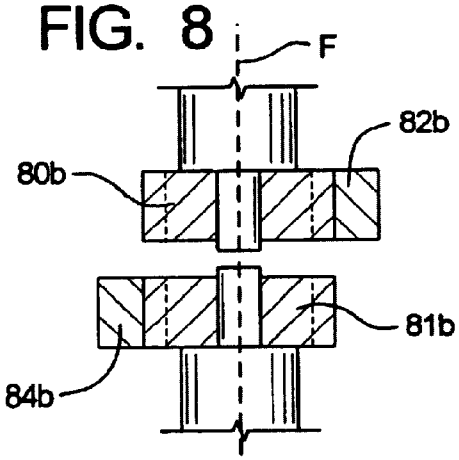
FIG. 8 is a somewhat schematic, front elevation, partial cutaway view of the clamp displacement system of FIG. 7.

Referring now to FIGS. 7 and 8, schematically depicted therein is an alternate clamp displacement system 46*b* that may also be substituted for the clamp displacement system 46 described above. This displacement system 46*b* is similar to the system 46*a* and will be described only to the extent that it differs from the system 46*a*.

The system 46*b* also comprises first and second drive pinions 80*b* and 81*b* associated with the racks 82*a* and 84*a*, respectively. However, the drive pinions 80*b* and 81*b* are stacked such that the axes of rotation of the exemplary drive pinions 80*a* and 81*a* are symmetrically arranged relative to a vertical axis F extending through the center of gravity of the clamp assembly 22. Like the displacement system 46*a*, the system 46*b* employs two drive pinions 80*b* and 81*b*that allow the racks 82*b* and 84*b*, and thus the clamps 42 and 44 attached thereto, to be independently moved along the structural member 40.

One variation on the system disclosed in FIGS. 7 and 8 is to arrange both of the racks 82*b* and 84*b* on the same side of the structural member 40. Another variation is to align the racks 82*b* and 84*b* with the longitudinal axis of the structural member 40, in which case the drive pinions 80*b* and 81*b* will be spaced (preferably but not necessarily on opposite sides) from the vertical axis F extending through the center of gravity of the assembly 22.

The present invention is preferably embodied as a clamp assembly 22 that is substantially symmetrical about a vertical axis extending through the center gravity of the clamp assembly 22. Such symmetry helps ensure that the vibratory forces generated by the vibratory device 36 and transmitted to the caisson 24 are applied along the longitudinal axis of the caisson 24.

However, in some situations, it may be possible to obtain a satisfactory clamp assembly according to the present invention that is not completely symmetrical. For example, one of the two clamp assemblies may be fixed and the other adjustable as described above; this arrangement would require only one drive pinion and rack and thus would be simpler to manufacture at the expense of loss of symmetry.

In addition, while as few as one clamp may be moved or adjusted with a drive pinion and rack as described above, three, four, or more clamps may be moved in accordance with the present invention in its broadest form. For example, three clamps may be provided on a structural member adapted to arrange the clamps at 120° increments about the circumference of the caisson. In this case, the racks and associated drive pinions would most efficiently be arranged at different horizontal levels so that they do not interfere with each other.

In another example, four clamps may be provided on a structural member adapted to arrange the clamps at 90° increments about the caisson circumference. Such a structural member would comprise two cross-arms that intersect at a central location. A likely arrangement for the racks and pinions would be a lower set on either side of one cross-arm and an upper set on either side of the other cross-arm.

From the foregoing, it should be clear that the present invention may be embodied in forms other than those described above. The above-described systems are therefore to be considered in all respects illustrative and not restrictive.

What is claimed is:

1. A clamp system for allowing a pile driving/pulling system to be attached to a caisson to be driven into or extracted from the earth, comprising:

a structural member adapted to be attached to the pile driving/pulling system;

first and second clamp systems comprising first and second clamp assemblies, respectively, that engage the structural member such that the first and second clamp assemblies can move along the structural member, where the first and second clamp systems operate in a first clamp mode in which the clamp assemblies are adapted to selectively clamp onto portions of the caisson, and a second clamp mode in which the clamp assemblies are adapted to release from the caisson;

first and second locking systems each having a locking assembly mounted on the first and second clamp assemblies, respectively, where each of the first and second locking systems operate in a first lock mode in which a position of the clamp assemblies relative to the structural member is fixed, and a second lock mode in which the clamp assemblies are allowed to move relative to the structural member; and a clamp displacement system having a clamp displacement assembly operatively connected between the structural member and the first and second clamp assembly; whereby when the first and second clamp systems are in the second clamp mode and the first and second locking systems are in the second lock mode, the clamp displacement system may be operated to displace the clamp assemblies relative to each other to obtain a desired clamp distance between the first and second clamp assemblies.

2. A clamp system as recited in claim 1, in which the clamp displacement assembly comprises:

a pinion member rotatably mounted on the structural member; and a rack member secured to the each of the first and second clamp assemblies; where the pinion engages the rack members such that rotation of the pinion causes movement of the first and second clamp assemblies.

3. A clamp system as recited in claim 2, in which an axis of rotation of the pinion is aligned with a center of gravity of the clamp system.

4. A clamp system as recited in claim 3, in which:

an opening is formed in the structural member; and the pinion is arranged in the opening such that a portion of the pinion is on a first side of the structural member and a portion of the pinion is on a second side of the structural member.

5. A clamp system as recited in claim 4, in which:

the first rack is arranged on the first side of the structural member; and the second rack is arranged on the second side of the structural member.

6. A clamp system as recited in claim 2, in which the first and second rack members are arranged on opposite sides of the pinion such that rotation of the pinion causes movement of the first and second clamp assemblies in opposite directions.

7. A clamp system as recited in claim 2, in which a guide portion is formed on each of the clamp assemblies to inhibit undesired movement of the rack members.

8. A clamp system as recited in claim 7, in which:

first and second guide portions are formed on the second and first clamp assemblies, respectively;

the first guide portion is arranged to inhibit undesired movement of the second rack member; and the second guide portion is arranged to inhibit undesired movement of the first rack member.

9. A clamp system as recited in claim 1, in which the clamp displacement system is operated to displace the first clamp assembly and the second clamp assembly in opposite directions to obtain a desired clamp distance between the first and second clamp assemblies.

10. A clamp system as recited in claim 1, in which the clamp displacement assembly comprises:

first and second pinions rotatably mounted on the structural member; and first and second rack members secured to the first and second clamp assemblies, respectively; where the first and second pinions engage the first and second rack members, respectively, such that rotation of the pinions causes independent movement of the first and second clamp assemblies.

11. A method of attaching a pile driving/pulling system to a caisson to be driven into or extracted from the earth comprising the steps of:

providing a structural member adapted to be attached to the pile driving/pulling system;

providing first and second clamp systems comprising first and second clamp assemblies, respectively, where first and second clamp systems operate in a first clamp mode in which the clamp assemblies are adapted to selectively clamp onto portions of the caisson, and a second clamp mode in which the clamp assemblies are adapted to release from the caisson;

engaging the first and second clamp systems onto the structural member such that at least the first clamp assembly can move in a limited manner relative to the second clamp assembly and to the structural member;

providing first and second locking systems having first and second locking assemblies, respectively, where locking systems each operate in a first lock mode in which the locking assemblies engage the structural member to fix a position of the clamp assembly associated therewith relative to the structural member, and a second lock mode in which the clamp assembly associated therewith is allowed to move relative to the structural member;

mounting the first and second locking systems on the first and second clamp assemblies, respectively; and providing a clamp displacement system having a clamp displacement assembly;

operatively connecting the clamp displacement assembly between the structural member and the first and second clamp assemblies; and operating the clamp displacement system to displace the first and second clamp assemblies relative to each other to obtain a desired clamp distance between the first and second clamp assemblies when the first clamp system is in the second clamp mode and the first locking system is in the second lock mode.

12. A method as recited in claim 11, in which the step of providing a clamp displacement assembly comprises the steps of:

rotatably mounting a pinion member on the structural member;

securing a rack member to each of the first and second clamp assemblies such that the pinion engages the rack members; and rotating the pinion to cause movement of the clamp assemblies.

13. A method as recited in claim 12, further comprising the step of arranging the first and second rack members on opposite sides of the pinion such that rotation of the pinion causes movement of the first and second clamp assemblies in opposite directions.

14. A method as recited in claim 13, further comprising the steps of:

forming an opening in the structural member; and arranging the pinion in the opening such that a portion of the pinion is on a first side of the structural member and a portion of the pinion is on a second side of the structural member.

15. A method as recited in claim 14, further comprising the steps of:

arranging the first rack on the first side of the structural member; and arranging the second rack on the second side of the structural member.

16. A method as recited in claim 12, further comprising the steps of:

forming first and second guide portions on the second and first clamp assemblies, respectively;

arranging the first guide portion to inhibit undesired movement of the second rack member; and arranging the second guide portion to inhibit undesired movement of the first rack member.

17. A clamp system as recited in claim 11, in which the step of providing the clamp displacement assembly further comprises the steps of:

rotatably mounting first and second pinions on the structural member;

securing first and second rack members to the first and second clamp assemblies, respectively; and engaging the first and second pinions with the first and second rack members, respectively, such that rotation of the pinions causes independent movement of the first and second clamp assemblies.

* * * * *